US010053117B2

(12) United States Patent
Traylor et al.

(10) Patent No.: US 10,053,117 B2
(45) Date of Patent: Aug. 21, 2018

(54) CONSISTS WITH LINEAR THROTTLE MAPPING

(71) Applicant: Progress Rail Locomotive Inc., LaGrange, IL (US)

(72) Inventors: Isaac Suwa Traylor, Brookfield, IL (US); Benjamin Arthur Raeder, Mt. Prospect, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 0 days.

(21) Appl. No.: 15/246,930

(22) Filed: Aug. 25, 2016

(65) Prior Publication Data

US 2018/0057020 A1 Mar. 1, 2018

(51) Int. Cl.
*B61C 17/12* (2006.01)
*B61C 5/00* (2006.01)

(52) U.S. Cl.
CPC ..... *B61C 17/12* (2013.01); *B61C 5/00* (2013.01)

(58) Field of Classification Search
CPC ..... B61C 17/12; B61C 5/00
See application file for complete search history.

(56) References Cited

U.S. PATENT DOCUMENTS 6,691,957 B2 * 2/2004 Hess, Jr. ..... B61L 3/006 105/61
6,763,291 B1 * 7/2004 Houpt ..... B60L 15/36 701/19
7,680,566 B2 3/2010 Liberatore
8,220,572 B2 * 7/2012 Donnelly ..... B60L 15/2045 180/65.265
8,428,798 B2 * 4/2013 Kull ..... B61L 15/0027 246/167 R
8,589,003 B2 11/2013 Brand et al.
2003/0213875 A1 * 11/2003 Hess, Jr. ..... B61C 17/12 246/167 R
2007/0219683 A1 * 9/2007 Daum ..... B61L 3/006 701/19
2010/0204856 A1 * 8/2010 Smith ..... B61C 17/12 701/19
2011/0283682 A1 * 11/2011 Gallagher ..... B61O 5/04 60/274

(Continued)

FOREIGN PATENT DOCUMENTS

CA 2455282 7/2004
CN 203331824 U * 12/2013
CN 203793335 8/2014

*Primary Examiner* — Tuan C To
(74) *Attorney, Agent, or Firm* — Miller, Matthias & Hull

(57) ABSTRACT

A method for operating a consist is disclosed. The consist includes a number of locomotives. The method includes selecting a power setting in a lead locomotive of the consist to generate an overall power request by an input device. Thereafter, a controller determines a power setting in each locomotive based on the overall power request. Next, the controller modulates a power output of one or more locomotives according to a difference between a measure of the overall power request and a measure of a combined power output of all locomotives according to the power setting determined by the controller, such that the combined power output matches the overall power request by keeping the power setting, determined by the controller, of each of the one or more locomotives unchanged.

20 Claims, 4 Drawing Sheets

(56) References Cited

U.S. PATENT DOCUMENTS

| | | | | |
|---|---|---|---|---|
| 2013/0046424 | A1* | 2/2013 | Gallagher | B61C 5/00 701/19 |
| 2015/0013312 | A1* | 1/2015 | Gallagher | F02M 25/0818 60/274 |
| 2015/0120166 | A1* | 4/2015 | Fisher | B61C 17/02 701/101 |

* cited by examiner

CONSISTS WITH LINEAR THROTTLE MAPPING

TECHNICAL FIELD

The present disclosure relates to a method for operating a consist. More particularly, the present disclosure relates to mapping of a throttle response in a consist to attain a linear throttle schedule.

BACKGROUND

Existing consist systems for locomotives facilitate controls of multiple locomotives to be linked together and respond in accord to an input generated within a lead locomotive. More particularly, consist systems commonly operate in a discrete number of power modes or power settings, usually eight, referred to as "notches". A notch at which a lead locomotive is set generally determines a speed of operation of the consist. To this end, a notch selected in the lead locomotive corresponds to a selection of the same notch in the remaining locomotives. This often results in inaccurate power generation as remaining locomotives possess different engine characteristics, in turn causing a non-linear increment of power.

Canadian Patent no. 2,455,282 ('282 reference) relates to a method and apparatus for reducing smoke emissions of a railroad locomotive during throttle notch changes. The method of the '282 reference discusses a delay in an application of a load to an engine of the locomotive and a modification of the engine's timing.

SUMMARY OF THE INVENTION

In one aspect, the disclosure is directed towards a method for operating a consist that is inclusive of multiple locomotives. The method includes selecting a power setting in a lead locomotive of the consist to generate an overall power request. The selection is performed by an input device. Thereafter, a controller determines a power setting in each locomotive based on the overall power request. Subsequently the controller modulates a power output of one or more locomotives according to a difference between a measure of the overall power request and a measure of a combined power output of locomotives according to the power setting, such that the combined power output matches the overall power request. The modulation occurs by keeping the determined power setting of each of the one or more locomotives unchanged.

In another aspect, the disclosure relates to a power management system for a consist. The consist includes a number of locomotives with a lead locomotive. An input device, associated with the lead locomotive, is adapted to select a power setting in the lead locomotive and generate an overall power request. The power management system includes a controller in communication with each locomotive and the input device. The controller is configured to determine a power setting in each locomotive based on the overall power request. Further, the controller is configured to modulate a power output of one or more locomotives of the consist according to a difference between a measure of the overall power request and a measure of a combined power output of all the locomotive according to the power setting. In so doing, the controller facilitates the combined power output to match with the overall power request by keeping the power setting of each locomotive unchanged.

In yet another aspect, the disclosure is directed to a consist that includes a number of locomotives, with a lead locomotive. Further, the locomotive includes an input device associated with the lead locomotive and a controller that is in communication with the locomotives and the input device. The input device is adapted to select a power setting in the lead locomotive and generate an overall power request. The controller is configured to determine a power setting in each locomotive based on the overall power request. Thereafter, the controller is configured to modulate a power output of one or more locomotives according to a difference between a measure of the overall power request and a measure of a combined power output of each locomotive according to the power setting, such that the combined power output matches the overall power request by keeping the power setting of each of the locomotives unchanged.

DETAILED DESCRIPTION

Figure 1:
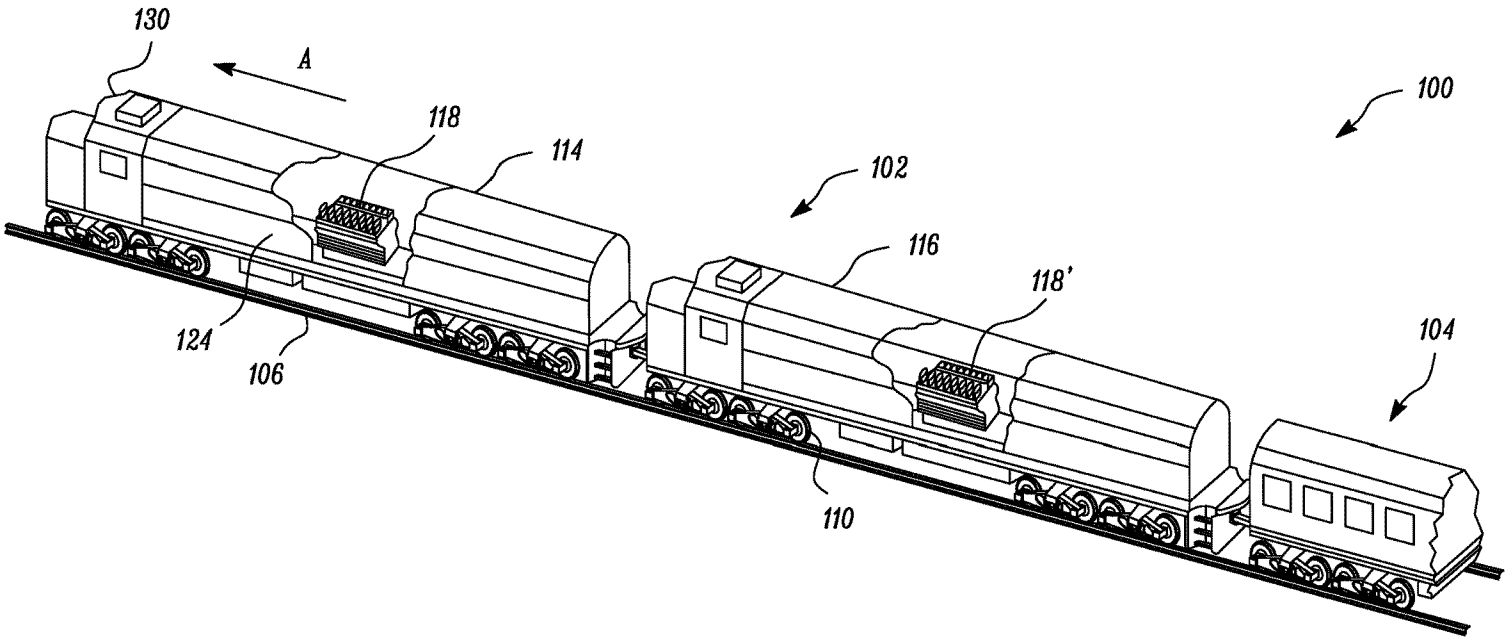
FIG. 1 is an exemplary consist including a locomotive system, in accordance with the concepts of the present disclosure.
Figure 2:
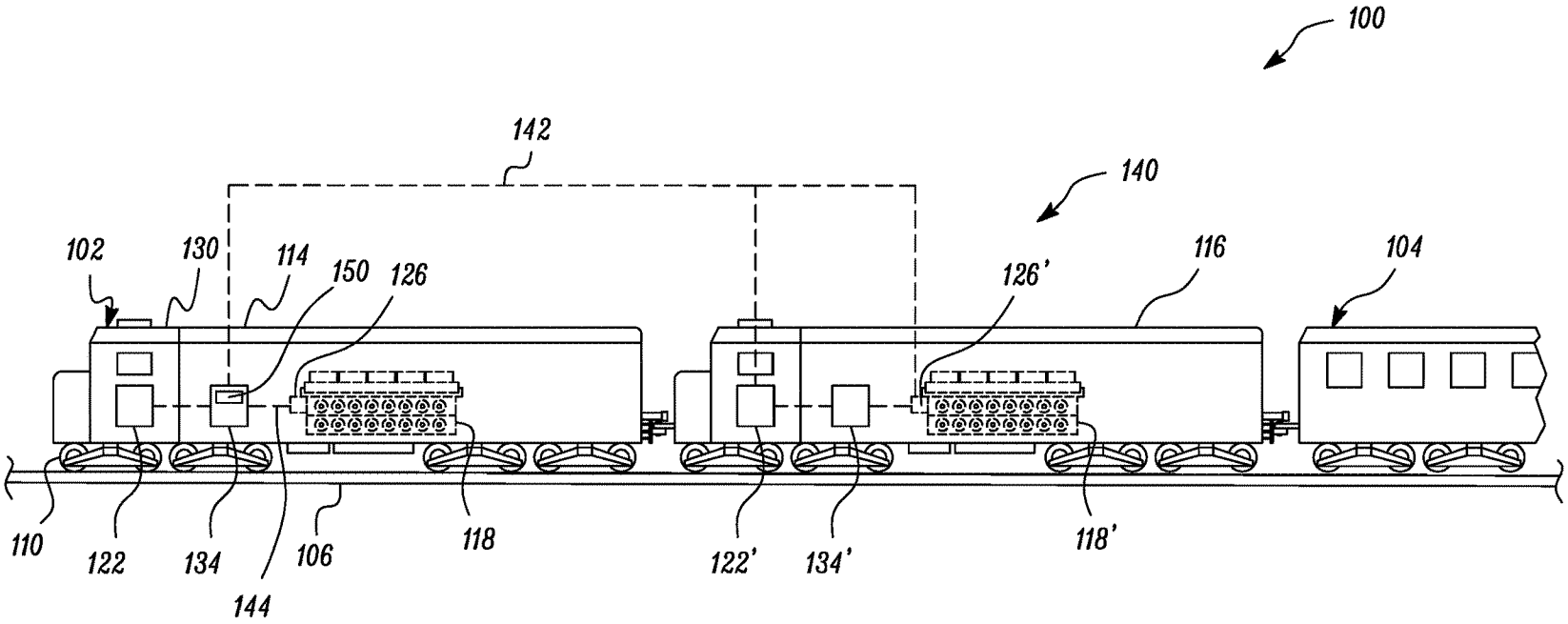
FIG. 2 is a schematic view of a power management system installed within the locomotive system, in accordance with the concepts of the present disclosure.

Referring to FIGS. 1 and 2, a consist 100 is shown. The consist 100 includes a locomotive system 102 with a rolling stock 104. The locomotive system 102 includes a number of locomotives connected in series, as is customary. In one example, the consist 100 is configured to pull the rolling stock 104 (or a train) in a forward direction (arrow, A), and generally traverse over an expanse of an associated railroad 106. The rolling stock 104 may embody one or more railroad cars that trail the locomotive system 102 during operation. Railroad cars may embody freight cars, tender cars, and/or passenger cars, and the consist 100 may employ different arrangements of the railroad cars and the locomotive system 102 to suit a generic use of the consist 100. In an embodiment, an arrangement of the locomotive system 102 may be varied. For example, the locomotives of the locomotive system 102 may be arranged at either ends of the rolling stock 104. Other known arrangements of the locomotives are also possible. In some embodiments, the locomotive system 102 may operate in an absence of the rolling stock 104 as well. Further, a number of wheels 110 are arranged throughout a length of the consist 100 in a known manner. The wheels 110 are configured to engage tracks of the railroad 106, and thereby support and facilitate a traversal of the consist 100 over the railroad 106.

Although aspects of the present disclosure are applicable to the consist 100, a variety of other environments may be contemplated in which said aspects may be suitably applied. In one implementation, applications involving machines that are generally constituted as serially connected power traction units may also use one or more of these aspects, in an appropriate fashion. Additionally, aspects of the present disclosure may also extend to consists operating on alternate railroad types, such as on a monorail system. Reference will now be made in detail to specific embodiments or features, examples of which are illustrated in the accompanying drawings. Wherever possible, the same reference numbers will be used throughout the drawings to refer to the same or the like parts.

The locomotive system 102 exemplarily includes two locomotives, namely a lead locomotive 114 and a trailing locomotive 116. The trailing locomotive 116 is configured to take power-based commands from the lead locomotive 114. A depiction and disclosure of two locomotives is provided for ease in explanation and understanding purposes, and, therefore, principles attested in the present disclosure may be suitably extended to consists that control a higher number of locomotives. As a feature of the present disclosure, it may be noted that the lead locomotive 114 may include an engine 118 which constitutes a different characteristic than an engine (discussed later) housed within the trailing locomotive 116. Nevertheless, both the lead locomotive 114 and the trailing locomotive 116 may operate in unison so that the consist 100 is propelled according to a linear function with reduced in-train forces. For this purpose, the lead locomotive 114 and the trailing locomotive 116 may operate with different power settings as well. Such functionality and related embodiments will be divulged as the description progresses.

The forthcoming discussion pertains to details of the lead locomotive 114 and various components of the lead locomotive 114. Unless specified otherwise, it will be understood that this discussion is applicable to the trailing locomotive 116, and the components of the trailing locomotive 116, as well. Whenever required, aspects of both the lead locomotive 114 and the trailing locomotive 116 will also be discussed by way of direct references. For simplicity, the lead locomotive 114 will be referred to as locomotive 114. The locomotive 114 includes a power source, constituted by the engine 118, and an input device 122 (FIGS. 2 and 3).

The engine 118 represents one of the commonly applied power generation units in traditional locomotive systems, and may be an internal combustion engine. The engine 118 is configured to power the consist 100's movement over the railroad 106. The engine 118 is housed within an engine compartment 124 of the locomotive 114. The engine 118 may be a self-propelled power source, powered at least party or fully by a fuel, such as liquefied natural gas (LNG). More particularly, the engine 118 may be a high-pressure natural gas engine that is configured to receive a quantity of gas by direct injection. In general, the engine 118 may use natural gas (NG), propane gas, methane gas, or any other suitable gaseous fuel, singularly or in combination with each other, to power the locomotive 114's (or consist 100's) operation. Alternatively, the engine 118 may be based on a dual-fueled engine system, a diesel-fueled engine system, or a dual-fueled electric engine system, etc. Further, the engine 118 includes a throttle unit 126 (FIG. 2) to facilitate a regulation of a fuel into the engine 118.

Furthermore, the engine 118 may embody a V-type, an in-line, or a varied configuration, as is conventionally known. The engine 118 is a multi-cylinder engine, although aspects of the present disclosure are applicable to engines with a single cylinder as well. The engine 118 may be one of a two-stroke engine, a four-stroke engine, or a six-stroke engine. Although not limited, the engine 118 may represent power generation units, such as a compression ignition engine powered by diesel fuel, a stratified charge compression ignition (SCCI) engine, a homogeneous charge compression ignition (HCCI) engine, a spark ignition engine, or a cryogenic fuel engine. Although the configurations disclosed, aspects of the present disclosure need not be limited to a particular engine type.

Figure 3:
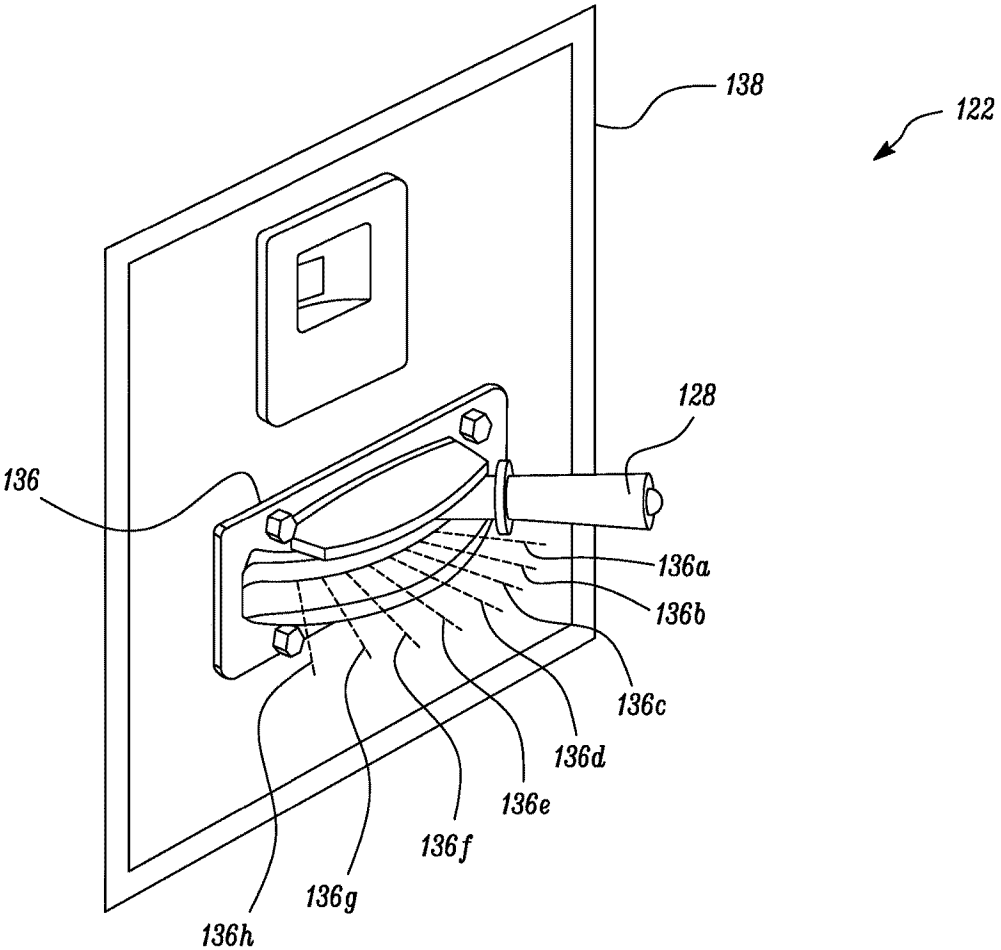
FIG. 3 is an input device of the lead locomotive of the locomotive system, in accordance with the concepts of the present disclosure.

Referring to FIGS. 2 and 3, the input device 122 is one of the traditionally applied throttle levers in the art. The input device 122 (or such throttle levers) may embody a manual control input device, such as a throttle handle 128 that is configured to communicate manual control inputs received from one or more operators in the locomotive 114 to the engine 118. The input device 122 is operatively coupled to the throttle unit 126 of the engine 118 via a controller 134 (discussed later), allowing the input device 122 to control/vary positions or settings of the throttle unit 126, in a known manner. In so doing, the input device 122 facilitates variations in a throttle response or a fuel inflow into the engine 118, in turn varying (incrementing or decrementing) the engine's power output when actuated. A variation of the power output enables a change in an engine speed. Additionally, the input device 122 is configured to select a power setting in the locomotive 114 to generate an overall power request in the consist 100. Although not limited, the input device 122 is positioned within an operator compartment 130 of the locomotive 114 so as to be accessible to one or more operators of the locomotive 114, in real time.

Referring to FIG. 3, the input device 122 is configured to operate in disjunctive power settings or incremental power modes or discrete throttle settings. More particularly, each disjunctive power setting corresponds to one of a discrete throttle setting in the locomotive 114. To this end, the input device 122 includes physically defined notches 136, or simply notches 136, that are representative of the power settings. A power setting is selected by the input device 122 by positioning the throttle lever (or the throttle handle 128) in one of the plurality of positions of the throttle lever. The plurality of positions of the throttle lever is represented by the notches 136. Corresponding each notch 136, an engine power is associated. The throttle handle 128 may be moved across the notches 136 and be snapped into each of the notches 136, during selection of a power setting. A movement of the throttle handle 128 across the span of the power settings may be performed manually by an operator, for example. The notches 136 are eight in number, and are categorized as a first notch 136*a*, a second notch 136*b*, a third notch 136*c*, a fourth notch 136*d*, a fifth notch 136*e*, a sixth notch 136*f*, a seventh notch 136*g*, and an eighth notch 136*h*, as shown. A variation in the number of notches 136 is possible. Collectively, the notches 136*a*, 136*b*, 136*c*, 136*d*, 136*e*, 136*f*, 136*g*, and 136*h*, may be referred to as notches 136, for ease. Typically, there is a spring loaded cam (not shown) integrated with the input device 122 that positions the throttle handle 128 securely into the physical notches 136, in a control panel 138 of the input device 122, hence the term "notch". By snapping the input device 122 into any of the notches 136, a particular power setting in the locomotive 114 is selected. Based on the power setting, a locomotive speed may be attained, but which may also depend upon a loading of the consist, a terrain of operation, and other known factors. In general, the operator may adjust the throttle handle 128 for more or less power if desired, so as to go faster or slower. In normal operation, the operator may select the notches 136 (or the power settings) in a sequential fashion over a span of the throttle schedule, i.e. from notch one (136*a*) to notch eight (136*h*), or from notch eight (136*h*) to notch one (136*a*), as it may be desirable to attain a substantially linear throttle response from the engine 118, both while accelerating and decelerating. In the depicted embodiment, the input device 122 is positioned in an idle setting of the locomotive 114.

Although the input device 122 has been discussed and illustrated as being a traditional control lever (throttle handle 128), it may be well understood that the input device 122 may represent a wide array of conventionally available user input interfaces. For example, the input device 122 may include touchscreens, graphical user interface (GUI), switches, joysticks, combinations thereof, etc., though which an input command or request may be generated. In an embodiment, it may be contemplated that the input device 122 is installed at a location remote from the locomotive 114 (or the consist 100), such as in an autonomous machine, so as to be remotely controllable.

Optionally, the input device 122 may abstain from being a physical entity and be incorporated as a logic into one or more of the controllers of the engines, such as controller 134. Such an incorporation may be applicable when autonomously driven locomotives are applied. In such a case, autonomous techniques may be applied to drive the locomotive 114 (or the consist 100) based on a pre-installed logical time-bound or speed-bound sequence. To this end, said logical sequences may issue instructions to the engine 118 based on a sequence of the power settings (or notches 136), such as from notch one to notch eight or from notch eight to notch one, for attaining locomotive acceleration or deceleration, respectively. Other types of power settings may be contemplated. Alternatively, logical sequences may be altered according to a dynamically changing course of locomotive operation. In an embodiment, automatic control input devices such as open-loop controllers, closed-loop controllers, or programmable logic controllers, remote control input devices, such as wired or wireless telemetry devices, combinations thereof, or any other control input device known in the art, may also be applied.

To distinguish the components of the lead locomotive 114 from the components of the trailing locomotive 116, the term 'lead' and 'trailing' may be prefixed to the components, every time a reference is made. More specifically, the engine 118, the input device 122, and the throttle unit 126 within the lead locomotive 114, may be respectively and/or interchangeably referred to as a lead engine 118, a lead input device 122, and a lead throttle unit 126. Similarly, an engine, a throttle unit, and an input device within the trailing locomotive 116, may be respectively and/or interchangeably referred to as a trailing engine 118', a trailing input device 122', and a trailing throttle unit 126'. Wherever aspects and functionalities common to both these component sets are described, sole references to each of the component, such as the engine 118, the input device 122, and the throttle unit 126, may also be used.

Referring again to FIGS. 1 and 2, the lead locomotive 114 may be designated as the lead or master unit by means of an on-board control switch (not shown), while the trailing locomotive 116 (or remaining locomotives) within the consist 100 may be designated as trailing or slave unit. In normal operation, the trailing locomotive 116 is adapted to receive control signals from the lead locomotive 114. Thus, in normal operation, if an operator in control of the lead locomotive 114 alters a locomotive control, the trailing locomotive 116 will respond in like manner. Such functionality ensures that the locomotives 114, 116 operate in tandem and in adherence with each other. Moreover, such a functionality is facilitated by way of a power management system 140, aspects of which are described further below.

Referring to FIG. 2, the power management system 140 is schematically shown. The power management system 140 includes the controller 134 and an electrical train line 142. In an embodiment, the power management system 140 is installed into the locomotives 114, 116 as a mode that may activated and deactivated, as and when required. An activation and deactivation of the power management system 140 may be facilitated by toggling the on-board control switch discussed above.

The controller 134 is positioned and associated with the lead locomotive 114. The controller 134 is configured to intelligently process a notch command obtained by selecting any of the notches 136 in the lead locomotive 114 using the input device 122. Based on the selection, the controller 134 is configured to provide a processed data to the trailing locomotive 116 (or, in embodiments, to each of the remaining locomotives of the consist 100). To this end, the controller 134 is coupled to both the input device 122 and the engine 118. More particularly, the controller 134 is in data communication with the input device 122 for receiving an input from an operator of the locomotive 114, while also being in data communication with the engine 118 via one or more data connection lines 144, for delivering a control input to the engine 118, as obtained from the input device 122. In an embodiment, the control input may represent any data known in the art that is relevant to an operation of the engine 118. Since each power setting (notches 136) in the lead locomotive 114 corresponds to a power demand, the controller 134 may be configured to receive communications from the input device 122 that pertains to the power demand. Since power generation may involve regulating a fuel inflow into the engine 118, the controller 134 is configured to communicate the power demand to the throttle unit 126 of the engine 118, thereby alter the throttle unit 126 and modulate the power output of the engine 118. In one embodiment, therefore, the power output is the throttle unit 126 of the engine 118. Data connection lines 144 between the controller 134 and the engine 118 may include wired connections, wireless connections, combinations thereof, or any other data communication means known in the art.

The controller 134 may include a purpose-built processor for effecting a control of the engine 118. More specifically, subsequent to the receipt of a signal from the input device 122, the controller 134 may process and convert the signal into a data with a feedback-specific format. Once the signal is processed, the signal may become compatible for a delivery and use with the throttle unit 126. In an example, the controller 134 forms a portion of any existing control module of the locomotive 114 that may be configured to pursue a variety of tasks associated with the locomotive's operation. In some embodiments, the controller 134 may include power electronics, preprogrammed logic circuits, data processing circuits, volatile memory, non-volatile memory, such as random access memory (RAM) and read-only memory (ROM), which include associated input and output buses. The controller 134 may be envisioned as an application-specific integrated circuit, or other logic devices, which provide controller functionality, and such devices being known to those with ordinary skill in the art. In an exemplary embodiment, the controller 134 may form a portion of one of the engine's electronic control unit (ECU), such as a safety module or a dynamics module, or may be configured as a stand-alone entity. As an option, the controller 134 may be configured into the control panel 138 to impart ease in functionality, accessibility, and service. Further exemplary arrangements may include the controller 134's accommodation within other panels or portions from where the controller 134 may remain accessible for ease of use, maintenance, and repairs.

The controller 134 may include and work in conjunction with software, firmware, combinations thereof, or any other logic, that may help the consist 100 achieve an incremental engine movement. Such logic may be applicable when the locomotives 114, 116 include engines 118, 118' with different engine characteristics. For example, an engine capacity, engine design, engine type, etc., among the locomotives 114, 116 of the consist 100 may differ, and therefore, for the same amount of fuel, engines 118, 118' of the locomotives 114, 116 may generate different power output profiles, possibly resulting in in-train forces during operation. Therefore, software, firmware, or related combinations, installed within the controller 134 may help attain an engine acceleration (and deceleration) profile that is linear in function, while also helping contain the in-train forces.

As an example, one feature of the power management system 140 is an independent setting of the controls of each of the locomotives 114, 116 of the consist 100. In this regard, in at least one mode of operation of the consist 100, the operating mode of the lead locomotive 114 is different as compared to the operating condition of the trailing locomotive 116. For example, the lead locomotive 114 may be operating at notch 5 (notch 136*e*) whereas the trailing locomotive 116 may be operating at a corresponding notch 4 (similar to notch 136*d* shown in FIG. 3).

To this end, the controller 134 is configured to generate a tabulation or a matrix based on the engine characteristics. The matrix may be a linear throttle map based on which the overall power request is generated. A matrix generation may happen each time a locomotive is selected as the lead locomotive 114 (for example, by the on-board control switch) and another locomotive is selected as a trailing locomotive 116 (or when multiple trailing locomotives are selected). The controller 134 may be able to generate the matrix by allowing an operator to feed in engine characteristics (i.e. power corresponding each notch position) manually, for example. Alternatively, the controller 134 may generate the matrix by a retrieval of engine characteristics from an online platform, if so has been provided. Further, it may also happen that the controller 134 is able to generate the matrix based on an initial run of the consist 100, and thereafter, subsequent runs may be optimized based on a data gathered during the initial run. Depending upon a number of locomotives (two in the present embodiment) in the consist 100, the controller 134 may be able to generate the matrix for each locomotive (i.e. the lead locomotive 114 and the trailing locomotive 116). Such a matrix may be stored as maps within a memory of the controller 134, and each of which may be retrieved every time the input device 122 is altered in the lead locomotive 114 and a corresponding data (such as the overall power request) is communicated to the trailing locomotive 116. In effect, the controller 134 is able to determine a power setting in each of the locomotives 114, 116 of the consist 100 based on the overall power request generated by the input device 122. In an embodiment, the controller 134 may also prepare and store a consolidated matrix chart so as to be mapped and applied whenever in a consist 100, the same locomotives are applied.

The controller 134 is also configured to generate a measure of the overall power request generated by the input device 122. For example, the controller 134 may use the matrix to tally a power corresponding to the notch selected by help of the input device 122, and thereafter assign a value to the selection termed as 'measure'. In that manner, the controller 134 is configured to determine the measure of power requested by the input device 122. Based on the measure of the overall power request, therefore, the controller 134 is configured to determine a power setting (or a position of the input device 122 within any of the notches 136) in each locomotive 114, 116. This is performed by scanning through the matrix associated with each locomotive 114, 116 of the consist 100. Resulting positions of the power setting (or notches 136) are determined based on a best possible combination of power setting that may be closest in measure to the measure of the overall power request.

The controller 134 includes a differentiating module 150 that tallies both the measure of the overall power request and the measure of a combined power output of the locomotives 114, 116 (gauged according to the resulting positions of the power setting), determined by the controller 134. Notably, the measure of the combined power output is obtained by summating a measure of power associated with said power settings in each of the locomotives 114, 116. If there exists a difference between the measure, the controller 134 is configured to modulate the power output by altering the throttle unit 126 of the engine 118 or the throttle unit 126' of the engine 118', or both, such that the combined power output matches with the overall power request generated by the input device 122. The alteration of the throttle unit 126 is configured to result in an attenuation of the combined power output to the measure of the overall power request. Such power modulation is attained by having the controller 134 operatively coupled to the throttle unit 126, 126' and alter the throttle unit 126, 126' by a predefined value. In an embodiment, the controller 134 may be connected to each of the throttle units 126, 126' of the locomotives 114, 116 of the consist 100, and individual locomotive power requests may be attenuated to meet the overall power request. To accomplish throttle modulation, the controller 134 may include a data chart that represents a power decrease (or power increase) corresponding every unit variation made to the throttle unit 126, and based on which a logic of the controller 134 may determine the extent to which the throttle unit 126 needs to be varied so that the measure of the combined power output is able to meet the measure of the overall power request, without variation. Moreover, the controller 134 performs such a modulation by keeping the power setting, determined by the controller 134, of each of the locomotives 114, 116 unchanged.

In one embodiment, the controller 134 may be configured to optimize fuel efficiency of the consist 100. In this regard, the power setting in each of the locomotives 114, 116 may be determined based on a fuel efficiency of the consist 100. Therefore, it may happen that alongside power, every notch 136 may also be designated with fuel efficiency figures, and every time a notch 136 is selected in the lead locomotive 114, a power setting combination is attained in the consist 100 that is also set according to the best possible fuel efficiency figures of the consist 100. Such logic may also determine the best notch combination for the consist 100 so that the best fuel efficiency is obtained. For example, when the operator selects the input device 122 into notch five (136*e*) within the lead locomotive 114, a command is transmitted via the electrical train line 142 to each input device 122, 122' in the consist 100 to attain an overall power request demanded by notch five. To meet the overall power request, the controller 134 may determine that a combination of a notch four (136*d*) in the lead locomotive 114 and a notch six (similar to notch 136*f* shown in FIG. 3) in the trailing locomotive 116 (i.e. notch 4-6 combination) may meet the power demand. However, it may also happen that if the controller 134 determines that a selection of notch three (136*c*) in the lead locomotive 114 with a combination of notch seven (similar to notch 136*g* shown in FIG. 3) in the trailing locomotive 116 (i.e. notch 7-3 combination) may yield a relatively lower fuel consumption, while meeting the same (or with permissible limits) the combined power output of the notch 4-6 combination, the controller 134 may either automatically, or with operator permit, shift the notch combination to the latter. Therefore, the controller 134 may store fuel efficiency figures associated with each notch position and/or a notch combination. Moreover, it is also possible that the controller 134 stores specifications and characteristics of the fuel used, such as a calorific value, type, etc., of the fuel. As with the matrix based on power, the controller 134 may store such fuel specifications corresponding every notch position in the consist 100 based on one of or a combination of an operator input, a retrieval from an online platform, or from an initial run of the consist 100, as well.

The electrical train line 142 facilitates communication and relay of an input command from the lead locomotive 114 to the trailing locomotive 116. For this purpose, the electrical train line 142 is connected between the controller 134 and the input device 122 of the trailing locomotive 116. In an embodiment, the electrical train line 142 may be a set of cablings that pass through a dedicated wire router arranged between the locomotives 114, 116. Such a set of cablings is connected to each of the controller 134 and the trailing input device 122', in a known manner. However, it may also be contemplated that the locomotives 114, 116 communicate wirelessly. In an embodiment, the electrical train line 142 represents a communication link, such as a Multiple Unit Control (MU) cable, which may provide a hard wire communication link between the locomotives 114, 116, operating according to standard train line protocols. For example, if the locomotive controls include microprocessors, the electrical train line 142 may be a network bus such as an Ethernet twisted pair cable, linking said microprocessors of the locomotives 114, 116. For example, when the locomotives 114, 116 are mechanically coupled together by a mechanical coupler (not shown), the electrical train line 142 may also be coupled to each of the locomotives 114, 116 via the mechanical coupler, as is customary.

In an embodiment, the trailing locomotive 116 includes a controller 134' as well. The controller 134' may be similar in form and function to the controller 134. Both the controllers 134, 134' may form a unitary controller that may serve a similar purpose as has been discussed for the controller 134. Each of the controllers 134, 134' may include respective transceivers, and the controllers 134, 134' may be configured to communicate, or receive signals from each other, via said transceivers. Such transceivers may be in turn connected to each other by the electrical train line 142. In some embodiments, the controller 134 may include multiple controllers, such as when more than two locomotives are applied in the consist 100. In such a case, each locomotive among the multiple locomotives may have a dedicated controller. Such multiple controllers may work in concert, enabling a control of the consist 100 by a single operator. As with the distinction imparted to the components of the lead locomotive 114 and the trailing locomotive 116, the controller within the lead locomotive 114 may be referred to as lead controller 134, while the controller within the trailing locomotive may be referred to as trailing controller 134'.

The input devices 122, 122' are also communicably coupled to each other via the controller 134, such that a signal generated by the lead input device 122 is read by the trailing input device 122'. This is possible by having the controller 134 determine a change in a position of the throttle handle 128 of the lead input device 122 and then relay that information to the trailing input device 122' via the electrical train line 142. By way of such a communication, a power setting (notch position) of the trailing input device 122' may be decided perhaps by the trailing controller 134', if the trailing controller 134' is available. As a result, the lead input device 122 may independently, or in combination with the trailing input device 122', signal a power need to their associated engines 118, 118', in turn instructing the consist 100 to operate at the generally specific consist speed. Because power settings (notch positions) in each locomotive 114, 116 correspond to the corresponding power of the engines 118, 118', a notch at which the lead input device 122 is set generally determines the speed of operation of the entire consist 100.

INDUSTRIAL APPLICABILITY

In a conventional operational scenario, the power management system 140 may be activated and a modulation of the power output may occur when a consist management system (or a consist management scheme) of the consist 100, that is configured to manage a power requirement (or distribute equivalent horsepower) across the consist 100, is also active. In an example, if an operator selects the throttle handle 128 (i.e. the lead input device 122), which controls the power setting of the lead locomotive 114, to notch six (136*f*), the throttle handle (i.e. the trailing input device 122', similar to the throttle handle 128) in the trailing locomotive 116 automatically moves to identical throttle notch six (similar to notch 136*f* shown in FIG. 3). Therefore, a notch 6-6 combination is attained. Such an operation may be performed by the consist management system (or the consist management scheme) of the consist 100, as is conventionally known and applied.

However, given the controller 134's functionality, and during an operation of the consist 100 according to the present disclosure, the controller 134 determines that the selection of notch six (136*f*) by the lead input device 122 has generated an overall power request. Based on the overall power request, the controller 134 transmits a measure of the overall power request to each of the locomotives 114, 116 of the consist 100, including the lead locomotive 114. Depending upon the overall power request, the controller 134 determines that a position of the throttle handle (i.e. of the trailing input device 122' and the lead input device 122) should automatically move to a certain notch position. As an example, combination of notch seven (136*g*) in the lead locomotive 114 and a notch five (similar to notch 136*e* shown in FIG. 3) in the trailing locomotive 116 is selected. This selection corresponds to a notch 7-5 combination that closely and best meets the overall power request, and also increments a power of the consist 100 in a controlled fashion, without substantial in-train forces.

Nevertheless, it may still happen that the notch 7-5 combination is a certain percentage higher (or lower in certain instances) than the measure of the overall power request. In such a case, the controller 134, by the differentiating module 150, modulates a power output of either or both of the locomotive 114, 116 according to a difference between the measure of the overall power request and the measure of the combined power output of the locomotives 114, 116 according to the notch 7-5 combinational power setting. This is to match the combined power output with the overall power request. The modulation is attained by an alteration the one or more of the throttle units 126, 126' by the controller 134. Notably, the controller 134 may perform this modulation by operatively adjusting the throttle unit 126, 126' of the engines 118, 118' by the predefined value, but by keeping the power setting (i.e. notch 7-5 combination) of the locomotives 114, 116 unchanged. By such modulation, the controller 134 attempts to attain the measure of the overall power request without variations, and re-maps the throttle response of the consist 100 to attain a more linear throttle response. As an example, if the overall power request is of a measure of 8000 horsepower (hp), and the combined power output (i.e. the notch 7-5 combination) generated 8200 hp, the controller 134, by the differentiating module 150, would alter either or each of the throttle units 126, 126' such that the combined power output (8200 hp) is attenuated to the overall power request (8000 hp).

Figure 4:
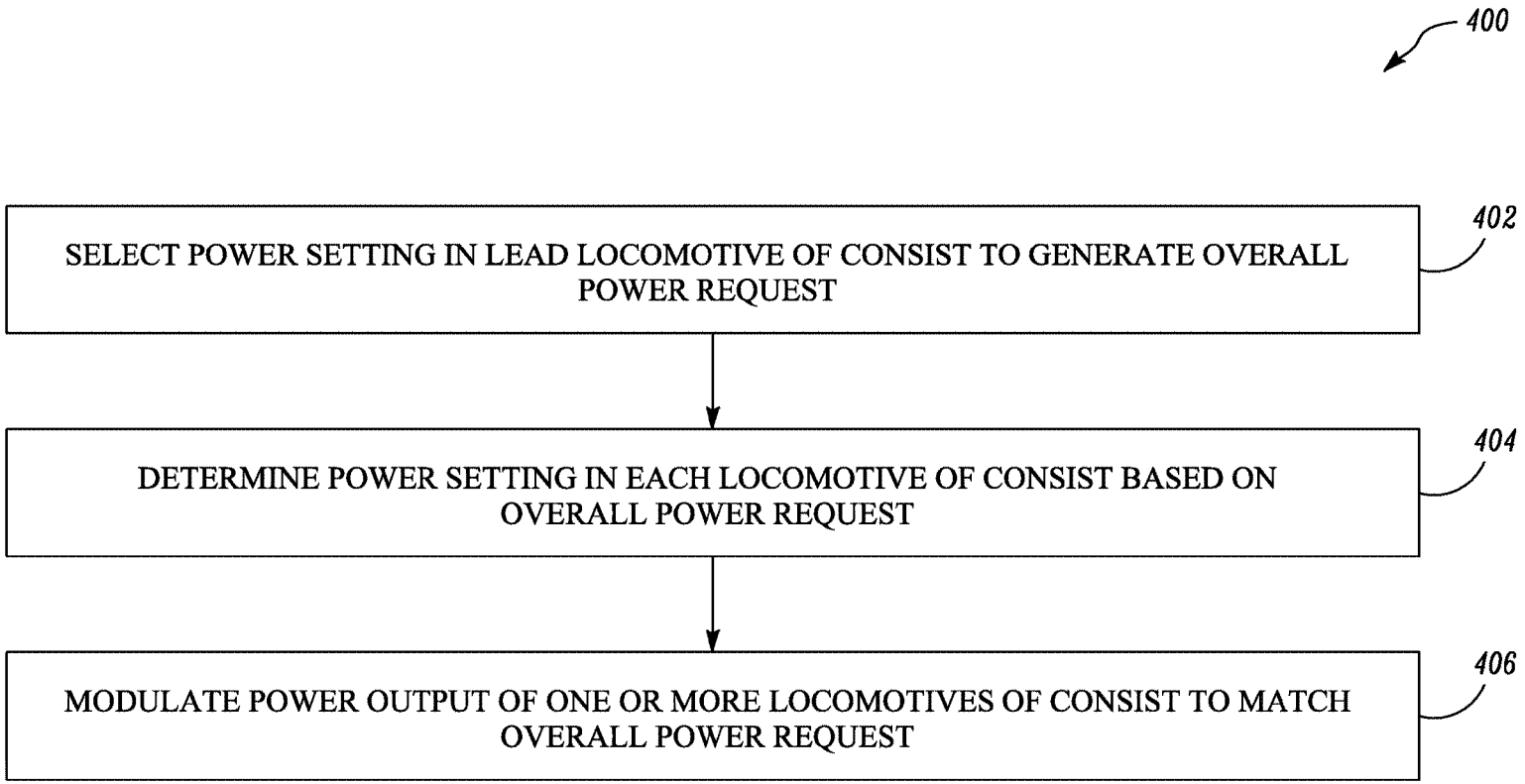
FIG. 4 is a flowchart depicting an exemplary method of operating the consist, in accordance to the concepts of the present disclosure.

Referring to FIG. 4, an exemplary method of operation of the consist 100 is set out. The method is explained by way of a flowchart 400 and is discussed in conjunction with FIGS. 1, 2, and 3. The discussion below also includes details pertaining to an operative connection between the lead locomotive 114 and the trailing locomotive 116. The method initiates at step 402.

At step 402, an operator selects a power setting (one of the notch 136) in the lead locomotive 114 using the input device 122. Pursuant to the selection, the controller 134 is able to detect the power setting and process a signal to generate an overall power request corresponding the power setting. Notably, the overall power request includes a measure, also computed by the controller 134. The method proceeds to step 404.

At step 404, the controller 134 communicates the measure of the overall power request to each of the locomotives 114, 116 of the consist 100, including the lead locomotive 114. As the trailing input device 122' is communicatively coupled to the controller 134, the trailing input device 122' follows suit and receives the measure as a signal. Therefore, once the signal is communicated, the controller 134 determines a power setting combination in the consist 100 that may best meet the measure of the overall power request. This power setting may be assumed by both the lead input device 122 as well as by the trailing input device 122'. Moreover, this power setting may be different from the convention where a notch selected in the lead locomotive 114 corresponds to the same notch being selected in the trailing locomotive 116 as well. As an example, if the operator selects notch five (136*e*) in the lead locomotive 114, the controller 134 generates a measure of the overall power request corresponding notch five (136*e*). Thereafter, the controller 134 communicates this measure to the trailing locomotive 116, while also relaying the measure to the lead locomotive 114. As a result, and based on the engine characteristics, the controller 134 determines that a notch four (136*d*) in the lead locomotive 114 and a notch six (similar to notch 136*f* shown in FIG. 3) in the trailing locomotive 116 is best suited to meet the said measure of the overall power request. Therefore, from an apparent notch 5-5 combination, the controller 134 selects a notch 4-6 combination to best meet the power requirement. The power output obtained by the power setting, as determined by the controller 134, is referred to as the combined power output. The method proceeds to step 406.

At step 406, the controller 134 uses the differentiating module 150 to see if there exists any difference between the measure of the overall power request and the measure of the combined power output. This is because according to conventional locomotive technology, the power setting (defined by the notches 136) and determined by the controller 134 at step 404 may be computed according to a power setting that is only closest to the measure of the overall power request. Thus, it may still happen that the measure of the combined power output may relatively minutely differ from the measure of the overall power request. As a result, the consist 100 may still be subject to in-train forces. To this end, the differentiating module 150 computes a difference between the measure of the overall power request and the measure of the combined power output, and modulates the throttle unit 126, 126' of the one or both the lead engine 118 and the trailing engine 118' to attain the exact measure of the overall power request.

The compensation of the power thus attained, by said modulation or attenuation for example, to attain the exact measure of the overall power request, substantially reduces in-train forces which is otherwise sustained when an exact power requirement is not met. Moreover, a power output of the consist 100 is incremented according to a linear curve, enabling a more comfortable, consistent, and predictable, consist movement.

It should be understood that the above description is intended for illustrative purposes only and is not intended to limit the scope of the present disclosure in any way. Thus, one skilled in the art will appreciate that other aspects of the disclosure may be obtained from a study of the drawings, the disclosure, and the appended claim.

What is claimed is:

1. A method for operating a consist, the consist including a plurality of locomotives, the method comprising:

selecting, by an input device, a power setting in a lead locomotive of the consist to generate an overall power request;

determining, by a controller, a power setting in each of the plurality of locomotives based on the overall power request; and modulating, by the controller, a power output of one or more of the plurality of locomotives according to a difference between a measure of the overall power request and a measure of a combined power output of the plurality of locomotives according to the power setting determined by the controller, such that the combined power output matches the overall power request by keeping the power setting, determined by the controller, of each of the one or more of the plurality of the locomotives unchanged.

2. The method of claim 1, wherein the power setting corresponds to one of a plurality of discrete throttle settings of each of the plurality of locomotives.

3. The method of claim 1, wherein the overall power request is generated based on a linear throttle map.

4. The method of claim 1, wherein the power setting in each of the plurality of locomotives is determined based on a fuel efficiency of the consist.

5. The method of claim 1, wherein modulating the power output includes altering a throttle unit of one or more of the plurality of locomotives and attenuating the combined power output to the overall power request.

6. The method of claim 1, wherein the measure of the combined power output is obtained by summating a measure of power associated with the power settings in each of the plurality of locomotives.

7. A power management system for a consist, the consist including a plurality of locomotives with a lead locomotive, an input device associated with the lead locomotive, the input device adapted to select a power setting in the lead locomotive and generate an overall power request, the power management system comprising:

a controller in communication with each of the plurality of locomotives and the input device, the controller configured to:

determine a power setting in each of the plurality of locomotives based on the overall power request, and modulate a power output of one or more of the plurality of locomotives according to a difference between a measure of the overall power request and a measure of a combined power output of all the plurality of locomotives according to the power setting determined by the controller, such that the combined power output matches the overall power request by keeping the power setting, determined by the controller, of each of the one or more of the plurality of the locomotives unchanged.

8. The power management system of claim 7, wherein the power setting corresponds to one of a plurality of discrete throttle settings of each of the locomotives.

9. The power management system of claim 7, wherein each of the plurality of the locomotives include a throttle unit, the power output being modulated by altering the throttle unit and attenuating the combined power output to the overall power request.

10. The power management system of claim 7, wherein the overall power request is generated based on a linear throttle map.

11. The power management system of claim 7, wherein the power setting in each of the plurality of locomotives is determined based on a fuel efficiency of the consist.

12. The power management system of claim 7, wherein the measure of the combined power output is obtained by a summating a measure of power associated with the power settings in each of the plurality of locomotives.

13. The power management system of claim 7, wherein the consist includes a consist management scheme, and the controller modulates the power output of one or more of the plurality of locomotives when the consist management scheme is active.

14. A consist, comprising:

a plurality of locomotives including a lead locomotive;

an input device associated with the lead locomotive, the input device adapted to select a power setting in the lead locomotive and generate an overall power request;

a controller in communication with each of the plurality of locomotives and the input device, the controller configured to:

determine a power setting in each of the plurality of locomotives based on the overall power request, and modulate a power output of one or more of the plurality of locomotives according to a difference between a measure of the overall power request and a measure of a combined power output of all the plurality of locomotives according to the power setting determined by the controller, such that the combined power output matches the overall power request by keeping the power setting, determined by the controller, of each of the one or more of the plurality of the locomotives unchanged.

15. The consist of claim 14, wherein the power setting corresponds to one of a plurality of discrete throttle settings of each of the locomotives.

16. The consist of claim 14, wherein the overall power request is generated based on a linear throttle map.

17. The consist of claim 14, wherein the power setting in each of the plurality of locomotives is determined based on a fuel efficiency of the consist.

18. The consist of claim 14, wherein the controller is configured to modulate the power output by attenuating the combined power output to the overall power request.

19. The consist of claim 14, wherein the input device is a throttle lever.

20. The consist of claim 19, wherein the power setting is selected by the input device by positioning the throttle lever in one of plurality of positions of the throttle lever.

* * * * *